US009805852B2

(12) United States Patent
Lee

(10) Patent No.: US 9,805,852 B2
(45) Date of Patent: Oct. 31, 2017

(54) TRANSFORMER CORE

(71) Applicant: LSIS CO., LTD., Anyang-si, Gyeonggi-do (KR)

(72) Inventor: Seungwook Lee, Anyang-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/986,227

(22) Filed: Dec. 31, 2015

(65) Prior Publication Data

US 2016/0314884 A1 Oct. 27, 2016

(30) Foreign Application Priority Data

Apr. 23, 2015 (KR) ..... 10-2015-0057300

(51) Int. Cl.

| | |
|---|---|
| ***H01F 27/24*** | (2006.01) |
| ***H01F 3/02*** | (2006.01) |
| ***H01F 27/245*** | (2006.01) |
| ***H01F 27/26*** | (2006.01) |

(52) U.S. Cl.

CPC ..... *H01F 3/02* (2013.01); *H01F 27/245* (2013.01); *H01F 27/263* (2013.01)

(58) Field of Classification Search

CPC ..... H01F 5/00; H01F 27/28; H01F 27/245
USPC ..... 336/200, 232, 217, 234
See application file for complete search history.

(56) References Cited

U.S. PATENT DOCUMENTS

| | | | | |
|---|---|---|---|---|
| 1,406,245 | A * | 2/1922 | Thordarson | H01F 27/245 336/210 |
| 4,479,104 | A | 10/1984 | Ettinger et al. | |
| 5,424,899 | A | 6/1995 | Scott et al. | |
| 6,070,317 | A * | 6/2000 | Allen | H01F 27/245 29/412 |

FOREIGN PATENT DOCUMENTS

| | | | | |
|---|---|---|---|---|
| CN | 102648505 | A | 8/2012 | |
| DE | 967478 | C | 11/1957 | |
| DE | 102010040162 | | 3/2012 | |
| FR | 2494026 | | 5/1982 | |
| FR | 2494026 | A2 * | 5/1982 | H01F 3/14 |
| GB | 2004129 | | 3/1979 | |
| JP | U4828003 | | 8/1946 | |
| JP | U4863210 | | 11/1946 | |
| JP | U50152149 | | 6/1949 | |
| JP | U5658832 | | 10/1954 | |
| JP | U60192417 | | 12/1985 | |
| JP | H0969450 | | 3/1997 | |
| WO | 8707073 | | 11/1987 | |

OTHER PUBLICATIONS

European Patent Office Application Serial No. 16151204.1, Search Report dated Sep. 22, 2016, 8 pages.
Japan Patent Office Application No. 2016-018979, Office Action dated Jan. 10, 2017, 2 pages.
State Intellectual Property Office of the People's Republic of China Patent Office Application No. 01610300887.5, Office Action dated May 31, 2017, 6 pages.

* cited by examiner

*Primary Examiner* — Tsz Chan

(74) *Attorney, Agent, or Firm* — Lee, Hong, Degerman, Kang & Waimey

(57) ABSTRACT

A transformer core includes: a plurality of core steel laminations; at least one guide slot on a surface of steel sheet forming each of the plurality of core steel laminations; and at least one shape retainer attached to the at least one guide slot joining a plurality of the steel sheets together.

7 Claims, 4 Drawing Sheets

TRANSFORMER CORE

CROSS-REFERENCE TO RELATED APPLICATION

Pursuant to 35 U.S.C. §119(a), this application claims the benefit of earlier filing date and right of priority to Korean Patent Application No. 10-2015-0057300, filed on Apr. 23, 2015, the contents of which are hereby incorporated by reference herein in its entirety.

BACKGROUND OF THE INVENTION

1. Field of the Invention

The present invention generally relates to a transformer core, an integral part of distribution/transmission transformers used in power systems, and more particularly, to a plurality of core steel laminations of the transformer core and an assembling method of the plurality of core steel laminations.

2. Description of the Conventional Art

A transformer is a static machine having a core and two or more windings wound on the core. Such a transformer transforms power from one circuit to another without change frequency through electromagnetic induction.

The electromagnetic induction produces an electromotive force across a conductor exposed to time-varying magnetic fields. And most transformers are used to increase or decrease the voltages of alternating current in electric power applications.

For large power transformers, the transformer cores are assembled by arranging a plurality of core steel laminations. And each of the plurality of core steel laminations comprises multiple steel sheets having a silicon content of 3 to 4% and a thickness of 0.23 to 0.35 mm.

In general, such a laminated core of a large-capacity transformer has about 1,000 mm thickness or greater thickness than 1,000 mm. It thus requires stacking of several thousands of silicon steel sheets with 0.23 to 0.35 mm thickness. And, for facilitating the stacking of those silicon steel sheets, one or more holes used to be drilled in the each of the silicon steel sheets depending on manufacturing needs.

FIG. 1 illustrates an example of a conventional transformer core 100 under assembly to form a finished transformer core for large power transformers.

Here, a plurality of core steel laminations 110, 120, 130, and 140 are arranged to receive more silicon steel sheets.

For instance, when the laminated core is completely assembled, the core steel lamination 110 can be then a core bottom yoke. And a result of this, the lamination 130 can be a core top yoke, and the laminations 120 and 140 can be a pair of legs that connect the core bottom yoke and the core top yoke.

For building the laminated core 100, those four core steel laminations 110, 120, 130, and 140 assembled in a stack are bound together by various means.

FIG. 1 does not give details of how to assemble the four core steel laminations. But, in FIGS. 2*a*, and 2*b*, the steel sheets 211 and 221 have a splice joint such that each sheet's leading ends joined to the other sheet's leading ends.

In FIG. 1, each of every steel sheets forming the core steel laminations 110, 120, 130, and 140 has at least one hole at its surface with a preset size respectively. For example, those holes indicate the regions that the steel sheets to position 150 and 170 on the first core steel lamination 110.

They also keep its lamination in shape while being assembled to form a finished lamination shape. For the similar purpose of the quick stacking, the second core steel lamination 120 consists of steel sheets with a plurality of holes. And, those holes have an average diameter of 20 to 30 mm.

In FIG. 1, a plurality of arrow lines depicted on the steel sheets illustrates an exemplary flows of the magnetic field when current flow the windings (not indicated) wound on the core steel laminations 110, 120, 130, and 140.

Here, due to the holes, the magnetic flux is not fairly uniform throughout an entire surface of the steel sheet. More precisely, the magnetic flux lines adjacent to the holes are more concentrated than the other regions remote from the holes. And such distorted magnetic flux distribution reduces the transformer's electrical performance.

As shown in FIG. 1, those drilled holes occupy the material of the steel sheet such that it reduces the stacking factor of the core. In addition, a burr is formed while punching a stacking hole in each steel sheet.

The burr forms gaps between the stacked steel sheets, thus causing a decrease in the stacking factor of the core. Also, the transformer core with the staking holes produces noise when an alternating current (AC) flows the windings wound on the core. The gaps between each of the stacked steel sheets make the bigger vibration noises.

To solve those technical problems, a method using a hollow container to cover the core steel lamination is proposed for quickly and safely stacking a plurality of one or more than one sheets of core steel materials forming the core steel lamination.

However this method is partially effective because it only eliminates the need of the holes fixing the steel sheet of the lamination. The problem is that making the shape of the hollow container corresponding to a unique shape of the transformer core steel lamination, e.g., a pot-belly shape, is simply a difficult and time and cost consuming task.

SUMMARY OF THE INVENTION

The present invention has been made to solve the problems mentioned above. A shape retainer is employed to facilitate assembling the core steel laminations.

The shape retainer is fixed or attached to the laminated core through a respective guide slot such that the guide slot does not reduce the desired electromagnetic feature of the core steel laminations.

The one or more shape retainers attached to the core steel lamination improve the stacking factor of the laminated core and reduce vibration noises coming from the conventional holes. Those retainers are also effective in preventing a temperature increase due to the use of the conventional transformer core.

In addition, the respective guide slot to receive the shape retainer locates at the place with the weakest strength of magnetic field intensity.

Thus, the attachment of the shape retainer to the guild slots is effective in minimizing the variations in the magnetic flux density of the steel sheet surface that caused by the conventional stacking holes, thus improving the transformer performance.

An exemplary embodiment of the present invention provides a laminated transformer core comprising: a plurality of core steel laminations; at least one guide slot on a surface of steel sheet forming each of the plurality of core steel lamination; and at least one shape retainer attached to the at least one guide slot joining a plurality of the steel sheets together.

In this case, the at least one guide slot is formed at a place where any change of the magnetic flux density of the steel sheet is minimized when current flow the laminated transformer core.

In the case, the at least one guide slot is formed at an outer peripheral side of the laminated transformer core.

In this case, the at least guide slot has a curved shape or a polygonal shape.

In this case, a number of guide slots is proportional to a size of the each steel sheet where the at least one guide slot is formed.

In this case, each of the at least one guide slot has the same shape as a traverse cross-section of the shape retainer.

In this case, the shape retainer is separable from each of the at least one guide slot.

In this case, the length of the shape retainer is proportional to a thickness of each of the plurality of core steel laminations.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, a laminated transformer core structure and a manufacturing method thereof according to the present invention will be described in detail with reference to the accompanying drawings.

Figure 1:
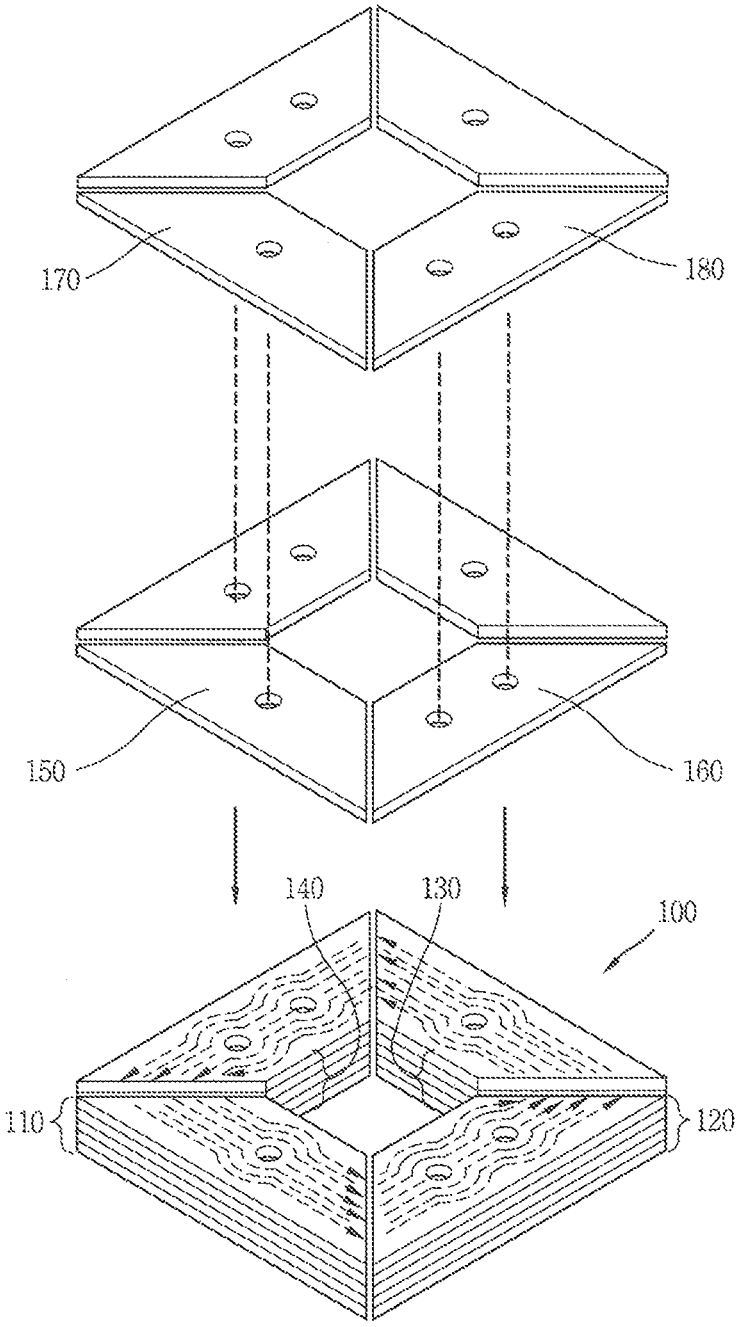
FIG. 1 Prior Art
FIG. 1 is a cross-sectional view illustrating an example of a conventional transformer core.
Figure 2A:
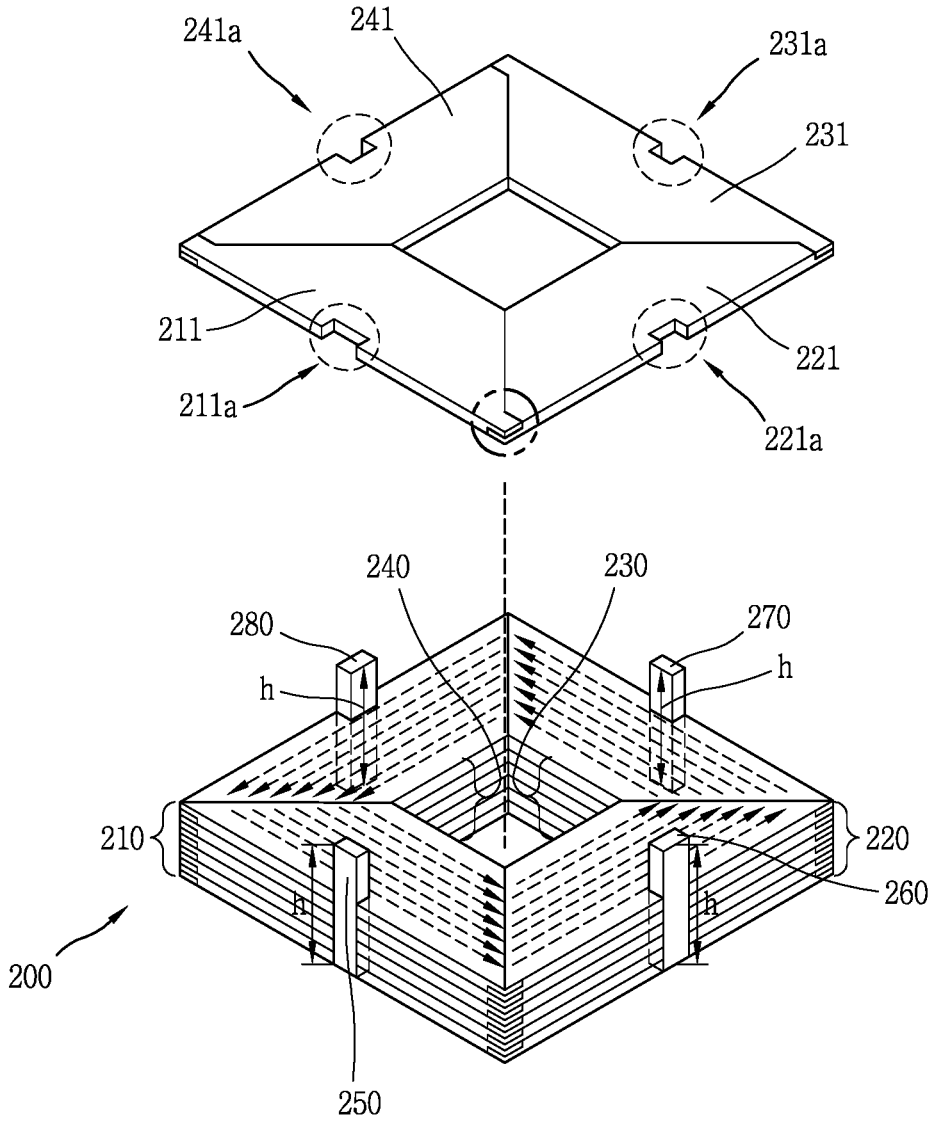
FIG. 2A is a cross-sectional view illustrating a transformer according to an exemplary embodiment of the present invention.

Referring to FIG. 2A, a transformer core 200 according to an exemplary embodiment of the present invention is illustrated. The laminated transformer core 200 has four core steel laminations 210, 220, 230, and 240. The four steel laminations 210, 220, 230, and 240 are made of a plurality of thin steel sheets stacked in the thickness direction of the transformer core 200.

Shape retainers 250, 260, 270 and 280 are implanted in the middle of the edges of the four steel laminations 210, 220, 230, and 240 respectively. The shape retainers 250, 260, 270, and 280 stand in the thickness direction of the transformer core 200 or perpendicular to the ground.

The length of those shape retainers is set as proportional to the thickness of the core steel laminations 210, 220, 230, and 240, and can be varied by other technical needs.

With the use of the shape retainers 250, 260, 270, and 280, the thin steel sheets 211, 221, 231, and 241 are quickly stacked on their corresponding core steel laminations 210, 220, 230, and 240. And the shape retainers embodied to the partially assembled core steel laminations help keep the core in its shape while forming a complete shape of the core 200.

As shown in FIG. 2A, the plurality of guide slots 211*a*, 221*a*, 231*a*, and 241*a* can be arranged at the outer edges of the steel sheets 211, 221, 231, and 241. Their locations are defined in that the guide slots avoid the path of the magnetic flux flow. Thus, when a current flows the windings (not shown) wound on the transformer core 200, any change of density of magnetic field lines, which is expected to occur by the holes (guide slots), can be minimized. That is, the guide slots occupy any place in the steel sheet that does not affect the original flux density.

When the core is under assembly, the retainers 250, 260, 270 and 280 implanted in the core can facilitate the placement of the steel sheets and easy assembling. The shape retainers fill the guide slots 211*a*, 221*a*, 231*a*, and 241*a* respectively. And, the filled slots can minimize any variations in the magnetic flux density of the steel sheets that used to be caused by the stacking holes as discussed above.

As an example of the present invention, the material of the shape retainer can be the same as the silicon steel sheets.

As an example of the present invention, the shape retainers 250, 260, 270, and 280 can be separable from the guide slots 211*a*, 221*a*, 231*a*, and 241*a*.

The shape and number of guide slots 211*a*, 221*a*, 231*a* and 241*a* are determined by taking into account factors, such as the easiness of manufacturing a transformer core, reduction of transformer noises, and variations in magnetic flux density.

The number of guide slots may be proportional to the area of the steel sheet where the guide slots are to be formed. The number of the guide slots is also determined by considering the breadth of the core steel laminations 210, 220, 230, and 240 of the core, the height of the core 200, and the like.

The length (h) of the shape retainer 250, 260, 270, and 280 is determined by the user's technical needs.

Figure 2B:
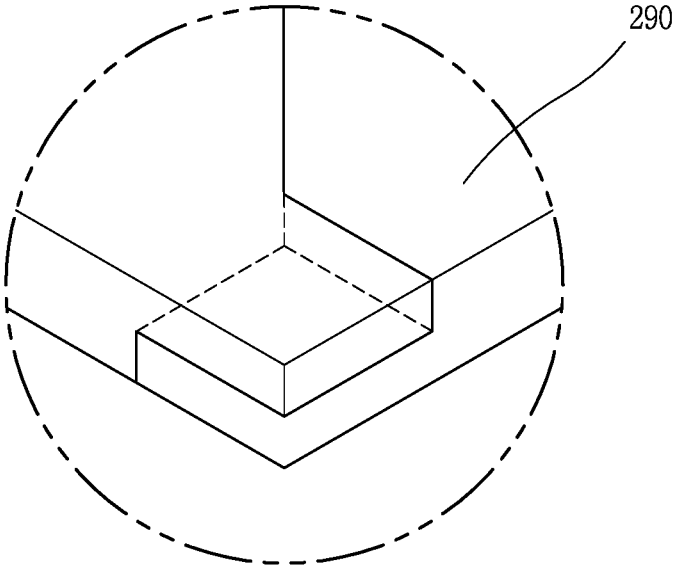
FIG. 2B is a cross-sectional view showing a joint of steel sheets of a transformer according to the present invention.

As shown in FIG. 2B, the steel sheets 211, 221, 231, and 241 may have a splice joint such that each steel sheet's leading ends are joined to the other sheet's leading ends.

Figure 3:
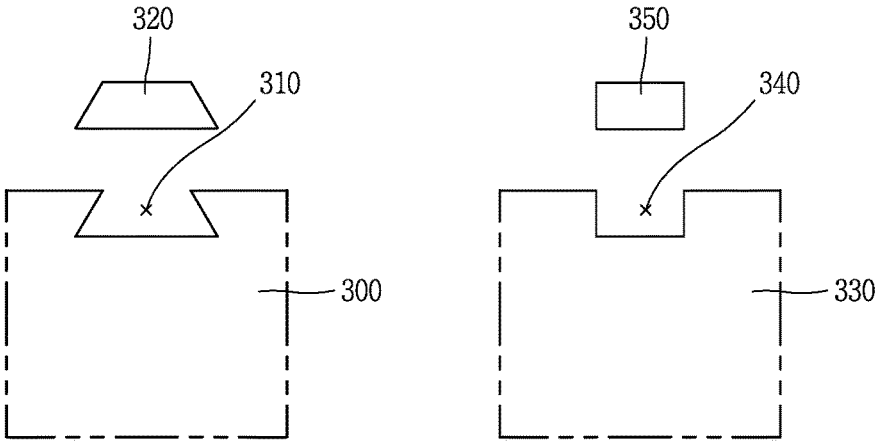
FIG. 3 is a cross-sectional view illustrating examples of a guide slot and a shape retainer according to the present invention.

FIG. 3 illustrates the shapes of a guide slot formed in a steel sheet and the shapes of a shape retainer attached to the guide slot as an embodiment of the present invention.

As an exemplary embodiment of the present invention, a steel sheet 300 of the transformer core 200 have a wedge-shaped shape retainer 320 and a wedge-shaped guide slot 310 to receive the insertion of the wedge-shaped retainer 320.

In another exemplary embodiment of the present invention, the steel sheet 300 of the transformer core 200 have a rectangular-shaped shape retainer 350 and a rectangular-shaped guide slot 340 to receive the insertion of rectangular-shaped shape retainer 350.

However, the shape of a guide slot and the shape of a shape retainer and the guide slot are not limited to the shapes mentioned above. That is, the guide slot in the steel sheet may form a curved shape, and the shape retainer attached to the curved guide slot may have the same curved shape, depending other technical needs.

One or more guide slots may have the aforementioned specific shape based on the area of the steel sheet where the guide slots form. Also, the shape retainer according to the present invention can be made of the material that can be easily manufactured.

Figure 4:
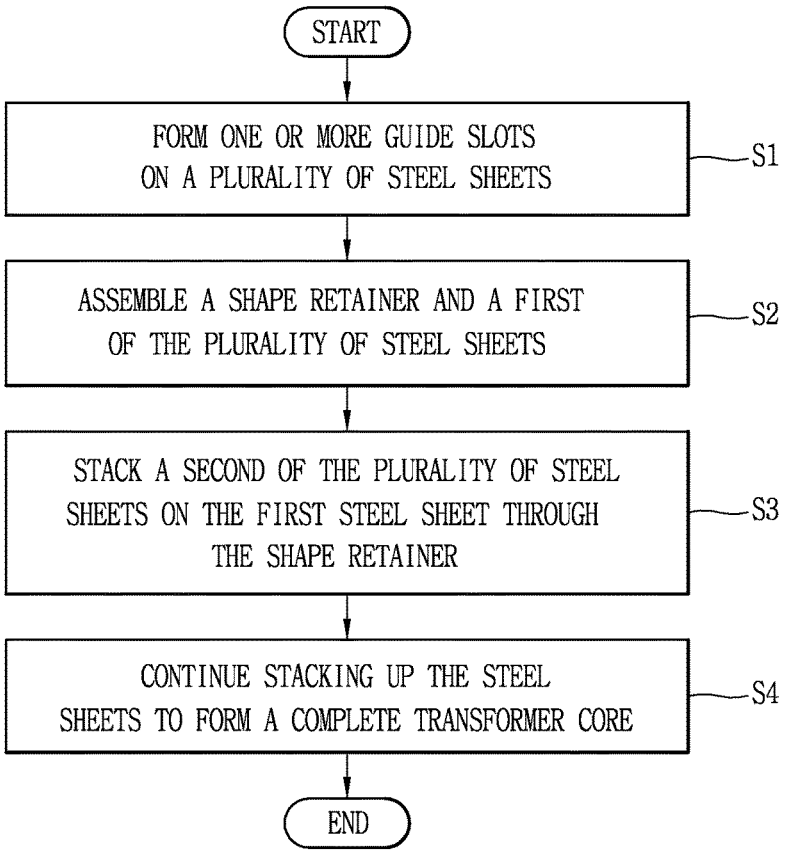
FIG. 4 is a flowchart showing a process of stacking steel sheets of a transformer core according to the present invention.

FIG. 4 shows the process of making a transformer core according to the present invention.

The first step is the step S1: forming one or more guide slots on a plurality of steel sheets forming the transformer core 200. The guide slot forms at one or more regions that bringing the least effects on the magnetic flux density of a first steel sheet when a current flows in a completed transformer core 200. The shape and number of guide slots are determined by considering technical issues including the easiness of manufacture of the core, the reduction of transformer noise, and the improvement of the stacking factor of the core.

The second step is the step S2: assembling a shape retainer and a first of the plurality of steel sheets. When the shape retainer is inserted into the guide slot, the entire surface of the steel sheet can be flat. Thus, the holes oriented non-uniformity of magnetic flux density on the steel sheet can be eliminated. The shape retainer can be made of a material that allows the length of the shape retainer to be easily adjusted in alignment with the core stack.

The third step is the step S3: stacking a second of the plurality of steel sheets on the first steel sheet through the shaper retainer that stands perpendicular to the ground. By using the shape retainer, the transformer core may be manufactured at a substantial time saving.

The fourth step is the step of S4: continuing the stacking up the steel sheets to form a finished transformer core.

What is claimed is:

1. A laminated transformer core comprising:

a plurality of core steel laminations each formed of a plurality of steel sheets stacked in a thickness direction of the transformer core;

at least one guide slot on a surface of each of the plurality of steel sheets; and at least one shape retainer attached to each of the at least one guide slot and joining the plurality of the steel sheets together, wherein a cross section of each of the plurality of core steel laminations comprises 4 identical trapezoids joined together to form a square, wherein each of the at least one shape retainer is formed at a center of an outer peripheral side of the plurality of steel sheets, and wherein both ends of each of the plurality of steel sheets are formed as a step to be joined with an adjacent steel sheet in an alternately overlapping manner.

2. The laminated transformer core of claim 1, wherein each of the at least one guide slot is formed such that any change of magnetic flux density of the corresponding steel sheet is minimized when currents flow through the laminated transformer core.

3. The laminated transformer core of claim 1, wherein each of the at least one guide slot has a curved shape or a polygonal shape.

4. The laminated transformer core of claim 1, wherein a number of the at least one guide slot is proportional to a size of the corresponding steel sheet.

5. The laminated transformer core of claim 1, wherein each of the at least one guide slot has a same shape as a traverse cross-section of the corresponding at least one shape retainer.

6. The laminated transformer core of claim 1, wherein each of the at least one shape retainer is separable from each of the corresponding at least one guide slot.

7. The laminated transformer core of claim 1, wherein a length of each of the at least one shape retainer is proportional to a thickness of each of the plurality of core steel laminations.

* * * * *